US005469819A

United States Patent [19]

Berger et al.

[11] Patent Number: 5,469,819

[45] Date of Patent: Nov. 28, 1995

[54] ADAPTIVE ENGINE PREHEAT

[75] Inventors: John G. Berger, Landisville; Dale A. Ashcroft, New Holland, both of Pa.

[73] Assignee: Ford New Holland, Inc., New Holland, Pa.

[21] Appl. No.: 348,911

[22] Filed: Nov. 25, 1994

[51] Int. Cl.[6] ..... F02N 17/02

[52] U.S. Cl. ..... 123/179.6; 123/179.21; 123/142.5 E

[58] Field of Search ..... 123/142.5 E, 145 A, 123/179.6, 179.15, 179.21

[56] References Cited

U.S. PATENT DOCUMENTS

| | | | |
|---|---|---|---|
| 4,404,932 | 9/1983 | Nakamura | 123/145 A |
| 4,436,064 | 3/1984 | Lamkewitz et al. | 123/142.5 E |
| 4,552,102 | 11/1985 | Egle | 123/145 A |
| 4,939,347 | 7/1990 | Masaka et al. | 123/179.6 |
| 5,050,545 | 9/1991 | Shirata et al. | 123/145 A |
| 5,063,513 | 11/1991 | Shank et al. | 123/142.5 E |
| 5,241,929 | 9/1993 | Grassi et al. | 123/179.6 |

FOREIGN PATENT DOCUMENTS

| | | | |
|---|---|---|---|
| 272474 | 12/1986 | Japan | 123/145 A |
| 9212334 | 7/1992 | WIPO | 123/142.5 E |

*Primary Examiner*—Henry C. Yuen
*Assistant Examiner*—Evick Solis
*Attorney, Agent, or Firm*—Griffin, Butler Whisenhunt & Kurtossy

[57] ABSTRACT

A diesel engine preheat system includes a temperature sensor for sensing the temperature of the engine coolant, engine heaters for heating the engine, and a microprocessor for calculating the duration of a preheat cycle. When an ignition switch is turned on, the microprocessor samples the output of the temperature sensor to determine the initial engine temperature. The microprocessor computes the required heating time from the initial temperature and a stored parameter representing the relationship between increase in temperature and heating time of the engine. The microprocessor energizes a relay to connect the engine heaters to a battery for the computed time. During the preheat cycle the microprocessor decrements the computed heating time and energizes a visual display to display the time remaining in the preheat cycle.

4 Claims, 2 Drawing Sheets

ADAPTIVE ENGINE PREHEAT

RELATED APPLICATION

This application incorporates by reference the disclosure of concurrently filed and commonly assigned application of John G. Berger et al., Ser. No. 08/348,910 entitled Security and Safety Interlocks For a Loader.

FIELD OF THE INVENTION

The present invention relates to an engine preheat system for preheating a diesel engine in a front end loader prior to the time the engine is started. More particularly, the invention determines the time required to preheat the engine to a desired starting temperature, counts down the time, displays the time remaining before the engine will reach the desired temperature, and during the countdown interval energizes engine heaters to heat the engine.

BACKGROUND OF THE INVENTION

It is well known that a diesel engine requires the application of heat to certain parts of the engine prior to starting in order for the engine to start. The preheat elements used to preheat the engine are subject to burnout if used unnecessarily. Furthermore, if an engine is warm it is usually not necessary to preheat it. Current diesel engine preheat systems do not discriminate between warm and cold engines and a preheat switch is provided so that an operator may manually control the preheat according to his best judgement. If the operator's judgement is poor, this may lead to attempted starting before the engine is warm enough or, alternatively, it may lead to premature failure of the preheat elements because the preheating is carried out longer than required.

SUMMARY OF THE INVENTION

An object of the present invention is to provide a diesel engine preheat system that calculates the optimum time for preheating the engine and then preheats the engine for the calculated time.

Another object of the invention is to provide a diesel engine preheat system which automatically controls the duration of the preheat interval as a function of the temperature of the engine at the time the ignition switch is turned on.

A further object of the invention is to provide a preheat system for a diesel engine, the system comprising temperature sensor means for sensing the temperature of the engine and producing an output signal representing the temperature, an ignition switch, heater means for heating the engine and a controller including means for sampling the output signal of the temperature sensor means when the ignition switch is turned on, means for calculating a value representing a preheat interval of time that the heating means must be energized to raise the temperature of the combustion air and parts of the engine combustion chamber from a temperature proportional to the temperature represented by the sampled output signal to a desired temperature for starting the engine, and means responsive to the calculated value for energizing the heater means for the interval of time.

Yet another object of the invention is to provide a preheat system as described above and further comprising display means, the controller including means for decrementing the calculated value and energizing the display means so that an operator may observe the time remaining in the preheat interval.

Other objects of the invention and the manner of making and using it will become obvious from the following description and the accompanying drawings.

DETAILED DESCRIPTION OF THE INVENTION

Figure 1:
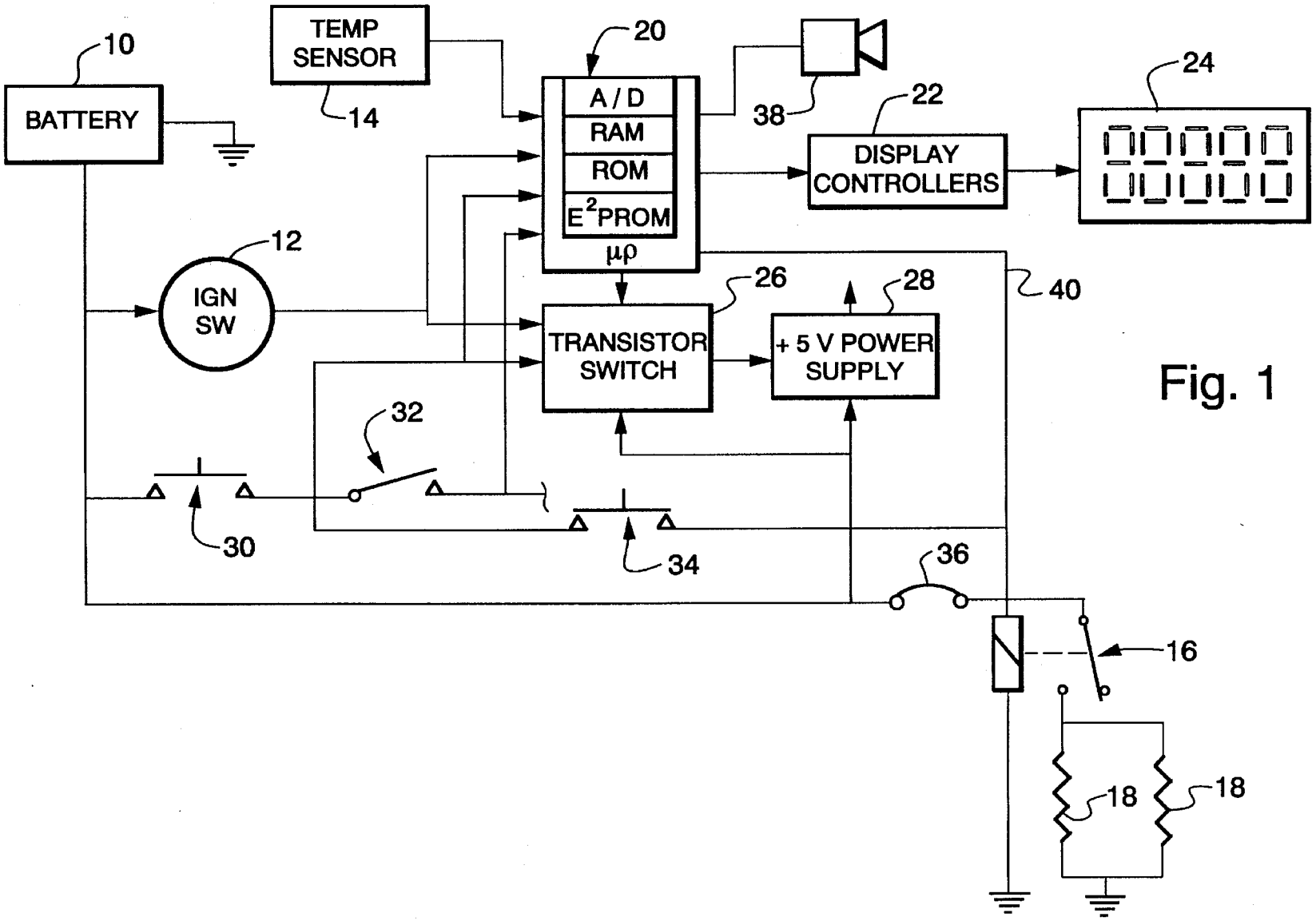
FIG. 1 shows an electrical circuit for controlling preheating of a diesel engine.

FIG. 1 shows a portion of a front end loader electrical circuit as described in the application of John G. Berger et al. referenced above. Insofar as the present invention is concerned, the electrical system comprises a battery 10, an ignition switch 12, a temperature sensor 14, a preheat relay 16, a plurality of preheat elements 18, a programmable controller 20, display controllers 22, a display 24, a transistor switch 26, a power supply 28, a seat switch 30, a seat belt switch 32, a manual preheat switch 34 and a beeper or audible alarm 38.

The battery 10 is a 12V battery which provides electrical power for the loader in conjunction with an alternator (not shown). The battery is connected to the ignition switch 12, the transistor switch 26, the power supply 28, one side of the seat switch 30, and through a circuit breaker 36 to the operating contact of preheat relay 16.

The ignition switch 12 is a conventional key-operated automotive ignition switch having accessory, off, ignition or run, and start positions. When the switch is in the run position, battery voltage is applied through the switch to an input of the programmable controller 20 and to the transistor switch 26.

Programmable controller 20 may be a Motorola MC68HC11A1FN microprocessor having RAM, ROM and $E^2$PROM memories and an A/D converter. Output signals from the microprocessor are applied to the display controllers 22 which may be, for example, two type UCN5833EP display controllers. Output signals from the display controllers are applied to display 24 which comprises a conventional 5-position, 7-segment liquid crystal display. Obviously, other types of microprocessors, controllers and displays may be utilized in implementing the invention.

The temperature sensor 14 may comprise any suitable means for sensing the temperature of the engine. It may, for example, be a thermistor device which senses the temperature of the coolant in the engine cooling system. The temperature sensor produces an analog output signal which is digitized by the A/D converter in the microprocessor and the microprocessor samples the output of the converter to obtain an indication of engine temperature.

The seat switch 30 is connected to an input of microprocessor 20, an input of transistor switch 26, to one side of seat belt switch 32, and to one side of the preheat switch 34. Seat switch 30 is a normally open switch located in the operator's seat so as to be closed when an operator is seated.

Seat belt switch 32 is a normally open switch located in the buckle of a seat belt so as to be closed when the seat belt is fastened.

The preheat switch 34 is a normally open, manually actuated switch located in the operator's compartment. When the operator is seated to close switch 30, he may press switch 34 to manually control preheating of the engine. When switches 30 and 34 are closed, battery voltage is applied to the coil of preheat relay 16. When the coil is energized, the relay contacts are operated so that battery voltage is applied through circuit breaker 36 and the relay contacts to the preheat elements 18.

The transistor switch 26 controls the power supply 28 which in turn provides +5V power to microprocessor 20, display controllers 22 and display 24. Although the power supply receives power from battery 10, the power supply does not provide the +5V output unless it is enabled by an output from transistor switch 26. The switch 26 is powered by the battery voltage but is turned on to enable the power supply 28 only when the ignition switch 12 is turned on or the operator sits in the seat to close switch 30.

The preheat elements 18 may be conventional glow plugs or resistive heating elements located in the cylinder head of the engine near where combustion takes place. The number of preheat elements may vary depending on the number of engine cylinders but there should be a heating element for each combustion chamber.

The circuit of FIG. 1 controls engine preheating in the following manner. Assume that the ignition switch is off and the operator is out of the loader. When the operator enters the loader and sits in the seat, battery voltage passes through the seat switch 30 to a control input of transistor switch 26 and to an input of microprocessor 20. Transistor switch 26 turns on thereby enabling the power supply 28. The power supply output powers up the microprocessor 20, controllers 22 and display 24.

When power is applied to the microprocessor, it executes a power-up reset, an Initialize routine during which a real time interrupt is enabled and begins executing a Main routine. The Main routine is executed every 32.77 ms and is interrupted every 4.1 ms by the Real Time Interrupt (RTI) routine. Reference may be made to the aforementioned copending application for a detailed explanation of these routines. Briefly, the RTI routine assures that the operator is seated and the seat belt is fastened before the engine may be started and the hydraulic controls enabled.

Figures 2, 3:
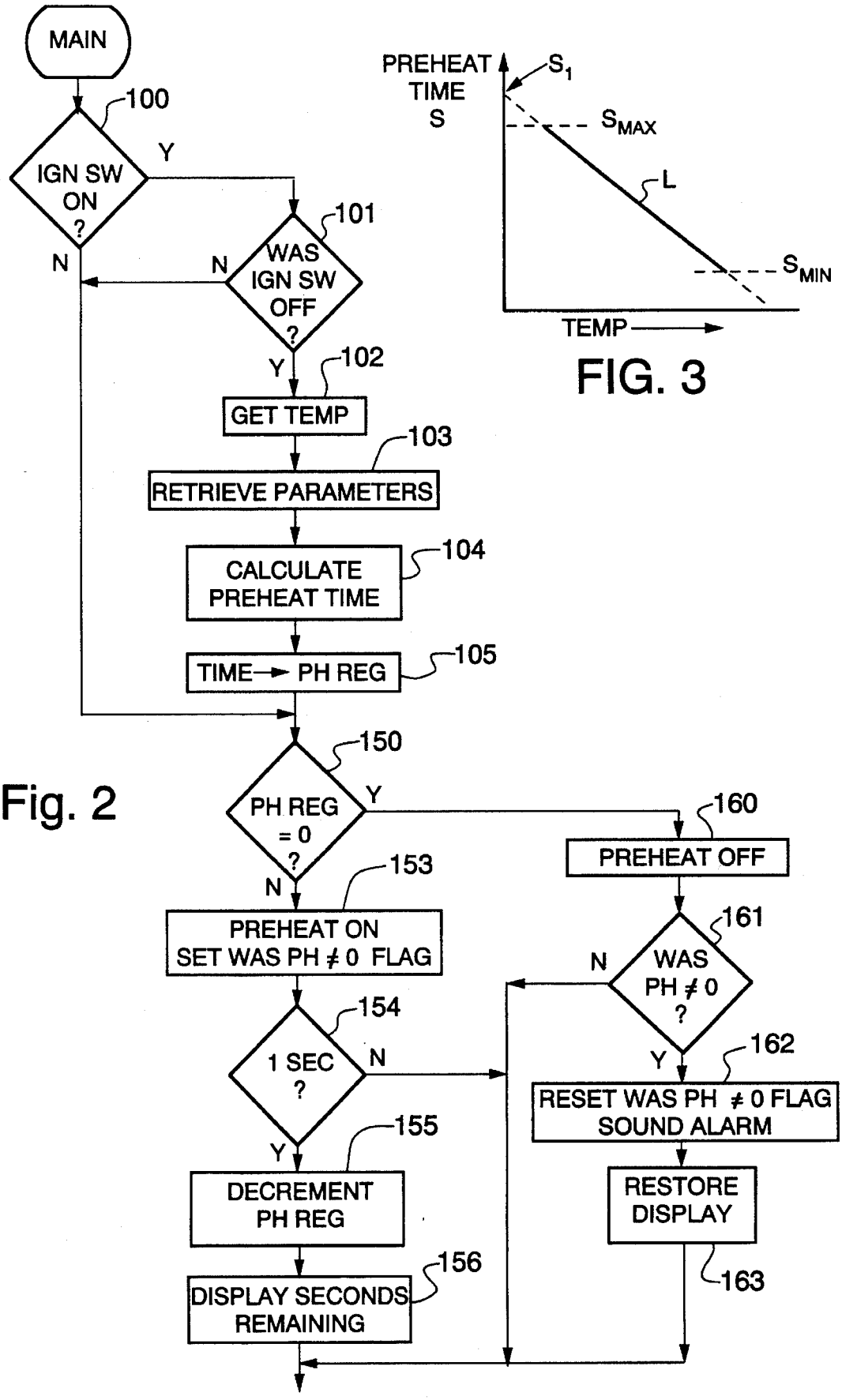
FIG. 2 is a flow diagram of a routine executed by the microprocessor of FIG. 1 to calculate and control engine preheating; and, FIG. 3 is a generalized graph showing the relationship between initial engine temperature and optimum preheat time.

FIG. 2 illustrates that portion of the Main routine relevant to engine preheating. Upon reaching step 100 the microprocessor tests the state of the ignition switch 12. Assuming the ignition switch is still off, the test at step 100 proves false. Later in the Main routine a register PH is tested at step 150 for a zero value. PH is reset during the Initialization routine so the test at step 150 proves true. At step 160 microprocessor sets (or maintains) an output signal on lead 40 (FIG. 1) so that the preheat relay 16 is not energized. The relay contacts are normally open when the relay is not energized so the preheat elements 18 are not energized.

At step 161 a WAS PH≠0 flag is tested to determine whether or not the PH register contained a value other than zero on the previous execution of the Main routine. The flag is reset during initialization to indicate that the PH register does not contain a non-zero value so on the first execution of step 161 the test proves false. The Main routine then continues with steps not relevant to the present invention.

Steps 100, 150, 160 and 161 are repeated every 32.77 ms as long as the operator remains seated and does not turn the ignition switch on, that is, to the run position. When the operator does turn the ignition switch to the run position, the new status of the switch is detected at step 100 the next time the Main routine is executed and the routine advances to step 101. The microprocessor saves the status of the ignition switch as determined at step 100 during one execution of the Main routine so that changes in the status of the switch may be determined. Step 101 tests the saved status and under the assumed conditions the saved status of the ignition switch was "off". The test at step 101 proves true. This means that the ignition switch has just been turned on and a preheating should take place. At step 102 the microprocessor gets the engine temperature by sampling the digital output of the A/D converter to which the temperature sensor 14 is connected.

At step 103 the microprocessor retrieves from non-volatile memory certain engine specific parameters required to calculate the desired engine preheat time for the type of engine being preheated. Digressing for a moment, the assignee of the present application markets various loaders having engines made by different manufacturers with the engines having different physical characteristics such as horsepower, number of cylinders, etc. A single type of Electronic Instrument Cluster (EIC) is used to monitor the status and perform certain control functions for the loaders regardless of engine type or other physical variations between the loaders. The EIC includes, among other elements, the switch 26, power supply 28, microprocessor 20, display controllers 22 and display 24 as illustrated in FIG. 1.

To permit the EIC to be used in the different loaders, a configuration code is stored in the non-volatile memory of the microprocessor as well as various parameters specific to the characteristics of the loader, such as engine type, number of cylinders, etc. During execution of the microprocessor program, when a loader specific parameter is required, the configuration code is accessed and used in turn to access the required parameter for the type of loader specified by the configuration code. Step 103 performs the functions of accessing the configuration code and using it to access the engine specific parameters necessary to calculate the optimum engine preheat interval. These engine specific parameters include M, $S_1$, $S_{MAX}$ and $S_{MIN}$.

Referring to FIG. 3, $$M = \frac{\Delta S}{\Delta \text{TEMP}}$$

is the absolute value of the slope of the line L where the horizontal scale represents the temperature T of the engine at the time preheating is initiated and the vertical scale S represents the interval of time required to preheat the engine from the initial temperature to a desired starting temperature. That is, for a specific engine there is a linear inverse relationship between the initial engine temperature and the required preheat interval. This relationship, that is, the slope M of line L, varies from one type of engine to another.

The point $S_1$ represents the intercept of the line L with the vertical axis.

To prevent burnout and increase the life of the preheat elements 18 it is desirable that the preheat elements be continuously energized for only a limited interval regardless of how low the initial engine temperature may be. That is, if the initial temperature of the engine is so low that it would take longer than $S_{MAX}$ seconds to heat the engine to the desired temperature then it is desirable to heat the engine for only $S_{MAX}$ seconds, and repeat the preheat cycle after a short interval. On the other hand, even though the engine may be initially warm enough to start it is preferable to preheat the engine for a minimum interval $S_{MIN}$ which may be on the order of one second. The slope M of line L, and the values $S_1$, $S_{MAX}$ and $S_{MIN}$ in seconds are determined experimentally for each type of engine that the EIC may be used with and these values are stored in non-volatile memory in the controller 20.

Returning to FIG. 2, after step 103 is executed to retrieve the values for M, $S_1$, $S_{MAX}$ and $S_{MIN}$, step 104 is executed to calculate the required preheat interval S in seconds according to the equation:

$$S=S_1-MT$$

The calculated value of S is then compared with $S_{MAX}$ and $S_{MIN}$. If $S_{MAX}>S>S_{MIN}$ then the value of S is stored in register PH (step 105) as the desired preheat time. If $S>S_{MAX}$ then $S_{MAX}$ is stored in PH and if $S<S_{MIN}$ then $S_{MIN}$ is stored in PH.

When the microprocessor tests the PH register at step 150 it finds that the register no longer contains a zero value. The microprocessor, at step 153, sets an output signal on lead 40 to energize the preheat relay 16. The relay contacts close so that battery voltage is applied to preheat elements 18 to thereby begin preheating the engine. The WAS PH≠0 flag is also set at step 153 to indicate that the PH register does not contain a zero value.

At step 154 a one-second timer is tested. This timer is reset to zero during initialization and has not been reloaded so the test at step 154 proves true. At step 155, the value in the PH register is decremented and the timer is reloaded to time a one-second interval. Then, at step 156 the value in the PH register is transferred to controllers 22 which control the display 24 so that the remaining time of the preheat interval is displayed. After step 156 is executed, the routine continues with other activities.

The next time the Main routine is executed, the test at step 100 proves true because the ignition switch is still on. The test at step 101 proves false because the ignition switch was not off the previous time the Main routine was executed. The routine branches around steps 102–105 and advances to step 150.

The PH register still contains the value as decremented at step 155 so the test at step 150 again proves false. At step 153 the signal on lead 40 is maintained so that the preheat elements remain energized. At step 154 the timer is tested again and since it will not have timed out the routine branches around steps 155 and 156.

Steps 100, 101, 150, 153 and 154 are executed every 32.77 ms until the one-second timer has tolled a one second interval. On the next execution of the routine after the timer has timed a one second interval the test at step 154 again proves true. The timer is restarted and the value in the PH register is decremented by one second (step 155). The decremented value in PH is then transferred to display controllers 22 (step 156) so that the display 24 displays the remaining preheat time.

For the next one second, steps 100, 101, 150, 153 and 154 are executed. During this interval controllers 22 continue to control display 24 to display the decremented value transferred to them when step 156 was executed and step 153 maintains the signal on lead 40 so that the preheat elements remain energized.

The above sequence is repeated until the value in the PH register has been decremented to zero. That is, steps 100, 101, 150, 153 and 154 are repeated for one second intervals and at the end of each interval steps 155 and 156 are executed to restart the timer, decrement the preheat time in the PH register and display the remaining time.

When the value in the PH register has been decremented to zero, the next execution of step 150 proves true. The microprocessor terminates the signal on lead 40 (step 160) so that the preheat relay is de-energized thereby terminating heating of the engine by preheat elements 18. At step 161 the WAS PH≠0 flag is tested. Since this flag was set during executions of step 153, this test now proves true. At step 162 the flag is reset and audible alarm 38 is sounded to alert the operator that the preheat interval has ended. The sounding of the audible alarm at this time provides an indication that the alarm, which is also sounded to alert the operator of an abnormal condition of various monitored functions, is working. Then, at step 152 the microprocessor sends signals to the controllers 22 so that the display 24 continues to display zeros as a visual indication to the operator that preheating has been completed. Since the PH register now contains a zero value and the WAS PH≠0 flag is reset, steps 100, 101, 150, 160 and 161 are repeated until the operator takes some action.

At the end of the preheat interval, if the operator tries to start the engine and it does not start, he may initiate another preheat sequence by turning the ignition switch off and then turning it on again.

Although a specific preferred embodiment of the invention has been described by way of illustration, it will be understood that various modifications and substitutions be made in the described embodiment without departing from the spirit and scope of the invention as defined by the appended claims.

We claim:

1. A preheat system for a diesel engine, said preheat system comprising:

temperature sensor means for sensing the temperature of said engine and producing an output signal representing said temperature;

an ignition switch;

heater means for heating said engine;

a programmable microprocessor, said programmable microprocessor including means for sampling said output signal when said ignition switch is turned on, calculating means for calculating a value representing an interval of time that said heater means must be energized to raise the temperature of said engine from the temperature represented by said sampled output signal to a desired temperature for starting said engine, and means responsive to said calculated value for energizing said heater means for said interval of time;

said programmable microprocessor including a non-volatile memory in which is stored a parameter value $S_{MAX}$ representing a maximum interval of time said heater means may be continuously energized and a parameter M defining a relationship between time of heating and change in temperature of the engine during the time of heating, said calculating means being responsive to said parameter M and said sampled output signal for calculating said calculated value; and, said calculating means including means for comparing said value calculated from M and the sampled output signal with the parameter value $S_{MAX}$ and means for using the parameter value $S_{MAX}$ for energizing said heater means when $S_{MAX}$ is smaller than the value calculated from M and the sampled output signal.

2. A preheat system as claimed in claim 1 and further comprising a display means for displaying during said interval of time, the remaining time in said interval of time.

3. A preheat system as claimed in claim 2 wherein said programmable microprocessor includes means for decrementing said calculated value to zero over said interval of time to obtain signal indications of the remaining time to preheat the engine, said display means being responsive to said signal indications for displaying said remaining time.

4. A preheat system as claimed in claim 1 and further comprising an audible alarm, said microprocessor including means for producing an output signal to sound said audible alarm when energization of said heater means ceases.

* * * * *